US010358761B2

(12) United States Patent
De Luca

(10) Patent No.: US 10,358,761 B2
(45) Date of Patent: Jul. 23, 2019

(54) HOUSEHOLD APPLIANCE WITH A ROTATIONAL USER INTERFACE ELEMENT

(71) Applicant: Electrolux Appliances Aktiebolag, Stockholm (SE)

(72) Inventor: Fernando De Luca, Fontanafredda (IT)

(73) Assignee: Electrolux Appliances Aktiebolag (SE)

( * ) Notice: Subject to any disclaimer, the term of this patent is extended or adjusted under 35 U.S.C. 154(b) by 83 days.

(21) Appl. No.: 15/352,621

(22) Filed: Nov. 16, 2016

(65) Prior Publication Data

US 2017/0137986 A1 May 18, 2017

(30) Foreign Application Priority Data

Nov. 16, 2015 (EP) ..... 15194771

(51) Int. Cl.

| | |
|---|---|
| ***F21V 33/00*** | (2006.01) |
| ***D06F 39/00*** | (2006.01) |
| ***D06F 25/00*** | (2006.01) |
| ***F21V 23/04*** | (2006.01) |
| ***A47L 15/42*** | (2006.01) |
| *D06F 58/28* | (2006.01) |
| *F21W 131/30* | (2006.01) |

(52) U.S. Cl.

CPC ..... *D06F 39/005* (2013.01); *A47L 15/4293* (2013.01); *D06F 25/00* (2013.01); *F21V 23/04* (2013.01); *F21V 33/0044* (2013.01); *D06F 2058/2803* (2013.01); *F21W 2131/30* (2013.01)

(58) Field of Classification Search

CPC ..... D06F 39/005; D06F 25/00; D06F 58/28; D06F 2058/2803; A47L 15/4293; F21V 23/04; F21V 33/0044; H05B 37/029; F21W 2131/30; F21W 2131/403; H01H 13/70; G06F 3/02; G06F 3/0362

See application file for complete search history.

(56) References Cited

U.S. PATENT DOCUMENTS

| | | | |
|---|---|---|---|
| 5,782,012 | A | 7/1998 | Sanders et al. |
| 2003/0024281 | A1 | 2/2003 | Peterson et al. |

(Continued)

FOREIGN PATENT DOCUMENTS

| | | | |
|---|---|---|---|
| CN | 204434991 | U | 7/2015 |
| DE | 4031266 | A1 | 4/1992 |

(Continued)

OTHER PUBLICATIONS

Extended European Search Report dated Apr. 20, 2016 in corresponding European Application No. 15194771.0.

(Continued)

*Primary Examiner* — Y M. Lee
(74) *Attorney, Agent, or Firm* — RatnerPrestia

(57) ABSTRACT

Household appliance (2) has a rotatable user interface element (44) which during a rotation by one full round engages in a discrete number of defined rotational positions. At least one group (50) of light elements (54) is provided. The appliance (2) is configured such that the light elements are illuminated and/or can be activated depending on the rotational state and/or movement of said rotatable user interface element (44) wherein the number of rotational position is larger than the number of light elements in said group (50).

15 Claims, 3 Drawing Sheets

(56) References Cited

U.S. PATENT DOCUMENTS

| | | | | |
|---|---|---|---|---|
| 2003/0024796 | A1 | 2/2003 | Peterson et al. | |
| 2005/0178167 | A1* | 8/2005 | Kim et al. | D06F 39/005 68/12.27 |
| 2005/0183469 | A1 | 8/2005 | Kang | |
| 2006/0164397 | A1 | 7/2006 | Bruntz et al. | |
| 2009/0201124 | A1 | 8/2009 | Kim et al. | |
| 2010/0000024 | A1 | 1/2010 | Hendrickson et al. | |
| 2010/0043499 | A1 | 2/2010 | Choi et al. | |
| 2013/0107495 | A1 | 5/2013 | Park | |
| 2013/0180840 | A1 | 7/2013 | Boesner et al. | |
| 2013/0255327 | A1 | 10/2013 | Park | |
| 2013/0271950 | A1 | 10/2013 | Park | |
| 2014/0049926 | A1 | 2/2014 | Bas et al. | |
| 2014/0131180 | A1 | 5/2014 | Williamson et al. | |
| 2014/0137608 | A1 | 5/2014 | Seikel et al. | |
| 2015/0299929 | A1 | 10/2015 | Yang et al. | |
| 2015/0299930 | A1* | 10/2015 | Yang et al. | F21V 33/0044 362/23.11 |
| 2015/0315737 | A1 | 11/2015 | Yang | |
| 2017/0137986 | A1 | 5/2017 | De Luca | |
| 2017/0137991 | A1 | 5/2017 | De Pellegrin et al. | |
| 2017/0235383 | A1* | 8/2017 | Goss et al. | G06F 3/0362 345/184 |
| 2019/0003102 | A1 | 1/2019 | Lv et al. | |

FOREIGN PATENT DOCUMENTS

| | | | |
|---|---|---|---|
| DE | 19908363 | A1 | 8/2000 |
| DE | 10261284 | A1 | 7/2004 |
| EP | 1555684 | A1 | 7/2005 |
| EP | 1884857 | A1 | 2/2008 |
| EP | 2589696 | A1 | 5/2013 |
| EP | 2620535 | A1 | 7/2013 |
| EP | 2650422 | A1 | 10/2013 |
| EP | 2933368 | A1 | 10/2015 |
| EP | 2937455 | A1 | 10/2015 |
| WO | 2015082127 | A1 | 6/2015 |

OTHER PUBLICATIONS

Extended European Search Report dated Apr. 5, 2016 in related European Application No. 15194759.5.

Extended European Search Reported dated Feb. 24, 2016 in related European Application No. 15194803.1.

European Communication Pursuant to Article 94(3) for European Application No. 15 194 759.5, dated Oct. 19, 2018, 5 pages.

European Communication Pursuant to Article 94(3) for European Application No. 15 194 759.5, dated Feb. 6, 2018, 5 pages.

Final Office Action for U.S. Appl. No. 15/352,645, dated Mar. 19, 2019, 11 pages.

Final Office Action for U.S. Appl. No. 15/352,636, dated May 9, 2019, 25 pages.

* cited by examiner

HOUSEHOLD APPLIANCE WITH A ROTATIONAL USER INTERFACE ELEMENT

CROSS REFERENCE TO RELATED APPLICATION

This application claims priority to European Application No. 15194771.0, filed Nov. 16, 2015, the content of which is hereby incorporated by reference in its entirety.

FIELD

The present invention generally relates to a household appliance, especially a washing machine, dryer or combined washer and dryer, both for domestic and professional use. More particularly, the present invention relates to a household appliance comprising a rotatable user interface element and a group comprising a plurality of light elements.

BACKGROUND

Known household appliances with a control panel provide graphics, for example text or symbols, and a rotatable user interface element, especially a knob, with a pointer which by rotation points to a respective symbol. The combination of the pointer of the knob and the symbol pointed at shows the user which selection of a program and/or a parameter thereof she or he has done. The symbols can relate to different programs or options for a selected program or additional options which can be selected on top of a basic program selection.

It is also known that household appliances have a rotatable control knob and several light elements which are illuminated when the control knob is operated. In some appliances, the symbols have for reasons of usability and aesthetics been replaced with LEDs, while the knob does not provide a pointing symbol anymore. Each LED is associated to a different type of selection, possibly indicated by some graphics or symbol close to it. Every step of the knob then is associated with an LED such that every time the knob is rotated by a step, a new LED is switched on accordingly. The number of steps of the knob therefore equals the number of LEDs.

The US 2014/0131180 A1 discloses an appliance with a control knob assembly with a control knob and a control panel, whereby a plurality of illumination elements is arranged on the control panel.

Disadvantages of known solutions are that if the number of possible selections is few, the user needs to perform big rotational movements with the rotational user interface element, which usually is not very comfortable to do.

Moreover, the rotational user interface element or knob provides a main gateway of usage of the appliance to the user. Therefore, the required handling of the user interface element has an impact on the perception of the user interface element which is projected on the overall handling and quality of the appliance by the user. An uncomfortable or cumbersome operation of a knob can lead to an overall minor quality impression of the whole appliance.

SUMMARY OF SELECTED INVENTIVE ASPECTS

An aim of aspects of the invention is to provide a household appliance with an improved usability.

Another aim of aspects of the invention is to provide a household appliance which offers a comfortable handling of the rotatable user interface element to the user.

Another aim of aspects of the invention is to provide a household appliance which offers a fit feel finish to the user.

Aspects of the invention relate to a household appliance, comprising a rotatable user interface element which during a rotation by one full round engages in a discrete number of defined rotational positions, whereby at least one group of light elements is provided, whereby the appliance is configured such that the light elements are illuminated and/or can be activated depending on the rotational state and/or movement of the rotatable user interface element, whereby the number of rotational position is larger than the number of light elements in the group.

A rotation by a full round denotes a rotation of the rotatable user interface element by 360° degrees. The discrete number of defined rotational positions corresponds preferably to positions in which the rotatable user interface element engages in or slips into, especially with a click. Preferably, when the user does not operate the rotatable user interface element, it engages in such a position.

Aspects of the invention are based on the consideration that the rotatable user interface element, which is used for selections regarding the machine state or programs/options for treatment routines, is a key element with respect to the user interaction and the impression the user gets from the machine. The user interface element is the central gateway of handling the machine, and the user will project the impressions of handling, feel, and quality of the user interface element onto the whole appliance.

In common machines, when the number of available selections that can be made by rotating or turning the control element is few, the user usually has to make large rotations with the rotatable element to reach them since they are usually distributed equally around the control element. These large angular movements are not comfortable to perform to the user and render the appliance hard to handle. The angular movement needed to reach a certain selection or step has also an impact on the perceived feeling of the control element. A negative impression is easily projected on the whole appliance by the user as mentioned above.

Applicant has found that a much better experience of the user interface element and therefore of the whole appliance can be achieved by unlinking the number of rotation positions into which the user interface can engage from the number of LEDs which can get illuminated when the user interface element is turned. Applicant has further recognized that the operation and handling of the appliance by use of a rotational control element can be made more convenient if the number of steps of the control element is made larger than the number of LEDs. This configuration leads to a comfortable and direct response with respect to the rotatable control element and simultaneously allows a convenient selection of options.

Since each state change of the rotatable user interface element can yield a feedback by a change in the illumination of the group of lights, this unlinking of knob steps and LEDs is not rendered counter-intuitive. To the contrary, as described above, it allows simultaneously a comfortable, convenient and efficient access to the desired setting.

Advantageously, when the rotatable user interface element is turned to an adjacent rotational position, the illumination state of the group of light elements is changed. For change of illumination state of the group it is meant that at least one light element therefore changes its illumination state. This change can therefore involve one, several or all light elements. A change of the illumination of the light element denotes especially the following possibilities. If the light element was illuminated, it turns off. It was not illuminated, it illuminates/turns on.

Preferably, when the rotatable user interface element is turned in one direction, the light elements of the group illuminate or turn off in a sequence. This sequence can, as an example, be a switch-on sequence. When the appliance is switched on, preferably by operating a dedicated user interface element such a switch, a first light element is illuminated, corresponding to a first choice or selection of a program or and/or parameter thereof. Further turning then can lead to the illumination of a further light element, etc. A sequence can also be a switch off-sequence.

The household appliance preferably comprises additional light elements on the user interface. In one preferred embodiment, the illumination state of these additional light elements is not linked to the operation of the rotatable user interface element. Their illumination status is the changed by operation of further user interface elements. In a second, alternative preferred embodiment, the illumination status of at least one of these additional light elements depends on the rotational position and/or movement of the rotatable user interface elements.

As an example, a turning of the rotatable user interface element leads to an illumination of light elements in a sequence. If the user operates an additional user interface element such as a button or switch, the turning of the rotatable user interface element illuminates an additional light element; further turning can lead to an illumination of a sequence of additional light elements.

The illumination state of a light element of the group preferably depends on the illumination state of the whole group for the current turning direction of the rotatable user interface element. This means that the illumination state of a light element is determined by the illumination state of the group and thereby illuminates in a determined and reproducible way. In this way, the user obtains a reliable impression of the operation of the appliance.

The sequential illumination or turning off of said light elements of said group advantageously depends on the number of subsequently reached rotational positions. This is especially true for a sequence, in which for each newly reached rotational position a light element changes its illumination state.

The illumination or turning off of said light elements of said group in a preferred embodiment additionally depends on the rotational speed at which said user rotatable interface element is turned. In this way, it is possible to allow a distinct selection even if the user is turning the rotatable user interface element very fast. As an example, if the rotational speed exceeds a given threshold value, for the next light element to get illuminated or turned off in a sequence, the fast rotation to the second next rotational position could be necessary. In other words, the user rotates in the same direction twice to a rotational position until the illumination of the group of light elements changes. Different steps of such kind can be chosen for different threshold values.

As another possibility, fast rotation of the rotational user interface element can also lead to the illumination of two or more sequential light elements at once, allowing to faster achieving an illumination of a desired light element.

As still another possibility, if the rotational speed is below a given threshold, the appliance can be configured in such a way that for the next light element to get illuminated or turned off in a sequence, the movement to two or more subsequent rotational positions is demanded. This can be advantageous if the user wants to get the next light element illuminated and turns slowly to avoid getting past the next light element in the sequence.

In a preferred embodiment, when the rotatable user interface element is turned in opposite direction to the direction in which the light elements of the group are illuminated, the light elements of the group turn out in a sequence.

Preferably, when the last light element of the group is illuminated in a sequence, such that all light elements are/have been illuminated, further turning of the rotatable user interface element in the same direction allowing the light elements to be illuminated makes the light elements turn off. Hence, by only turning the rotatable user interface further, the user can turn off all light elements and stop the sequence. The user does not have to turn the rotatable user interface element all the way back in opposite direction to turn off all light elements. This functionality is allowed by the number of rotational positions being larger than the number of light elements, making additional rotational positions for the turning off of all light elements available.

Preferably, further turning of the rotatable user interface element in the same direction starts again the sequence of illuminations of the light elements of the group. Preferably reversing the turning direction leads to a sequential turning off of the light elements.

In a preferred embodiment, when the respective next light element is illuminated in a sequence, the previously illuminated light elements stops being illuminated. Therefore, only one light element is illuminated contemporaneously.

In another preferred embodiment, when the respective next light element is illuminated in a sequence, the previous light element remains illuminated. Therefore, except for the first light element to be illuminated in a sequence, starting with the second illuminated light element always two or more light elements are illuminated contemporaneously.

In a preferred embodiment of the appliance, the subgroup of light elements is arranged peripherally to the rotatable user interface element. This peripheral arrangement is an indication to the user that by operating the rotatable user interface element, she or he can change the illumination state of the respective light element and thereby select a program and/or parameters thereof.

The group is preferably formed as a segment of a circle or as a straight row.

The rotatable user interface element is advantageously a knob.

The knob is preferably a push knob. The push-functionality can preferably be used to confirm a selection which has been made by turning the rotatable user interface element.

Advantageously, the group of light elements is essentially arranged vertically in an operational state of the appliance. The operational state of the appliance denotes the mounted state of normal operation of the appliance, whereby a clockwise rotation of the rotatable user interface element illuminates the group from top to bottom. In this way, when the rotatable user interface element is turned clockwise, the sequence of successive illuminations of light elements basically follows the turning of the rotatable user interface element and yields a very intuitive handling impression of the appliance.

Preferably the group of light elements is essentially arranged vertically in an operational state of the appliance, whereby a counterclockwise rotation of the rotatable user interface element illuminates the group from bottom to top.

The respective light element is preferably built as an LED.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings.

DETAILED DESCRIPTION OF EXAMPLE EMBODIMENTS

Figure 1:
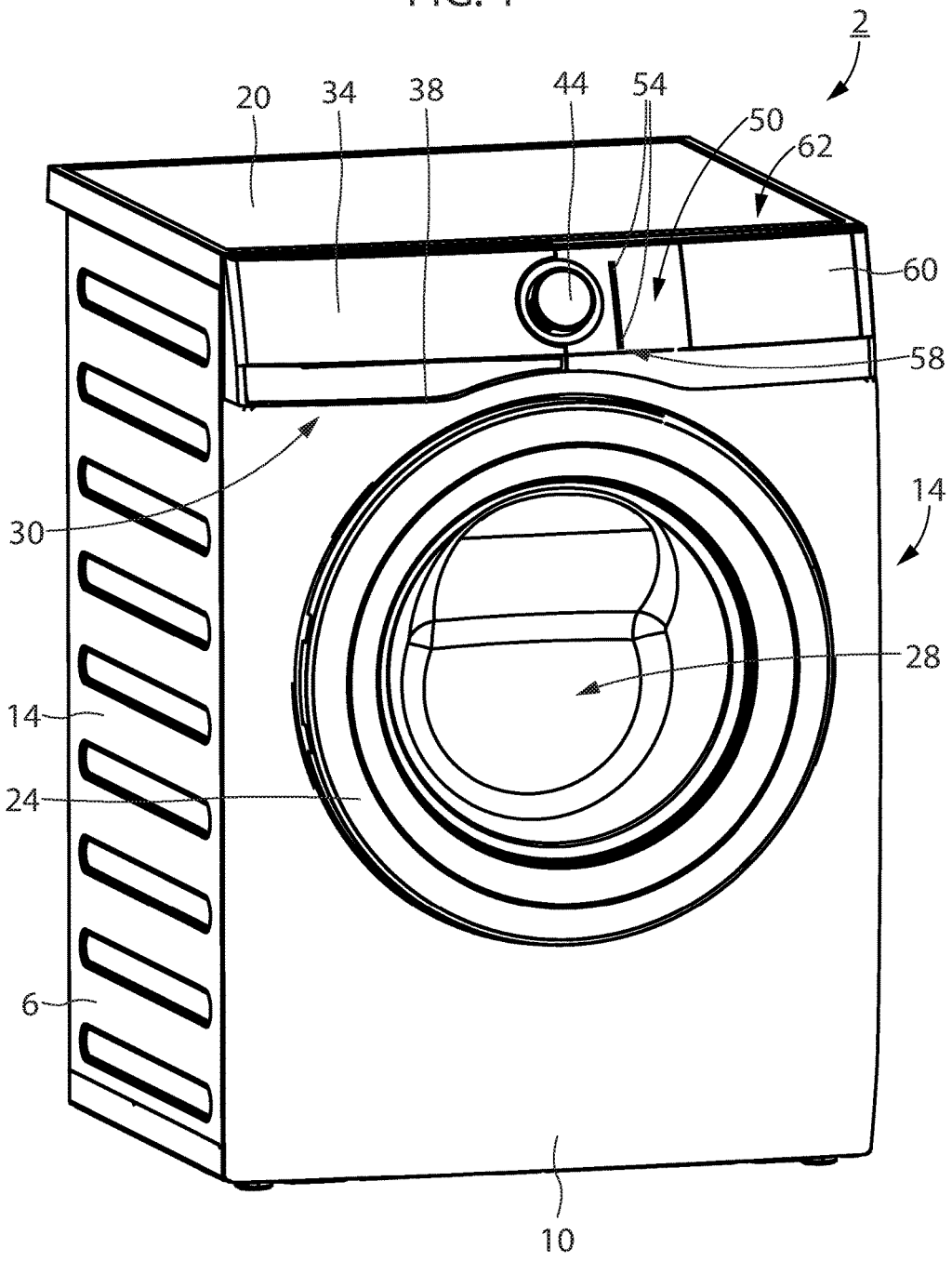
FIG. 1 shows a laundry washing machine in a preferred embodiment.

In FIG. 1, a household appliance which is built as a laundry washing machine 2 is shown which is preferably built as a front-loading washing machine and comprises a housing or casing 6 with a preferable parallelepiped shape, the casing 6 comprising a front wall 10, two side walls 14, a cover plate 20 and a rear plate (not shown). Front wall 10 and side walls 14 are preferably part of a cabinet. A front door 24 is provided which can be opened for loading or unloading laundry through an opening 28 into a washing drum.

Advantageously a washing tub is contained within casing 6, whereby a rotatable and perforated drum is contained by said washing tub. Both washing tub and drum have a substantially cylindrical shape. Advantageously the tub is suspended in a floating manner inside casing 6 by means of a number of coil springs and shock absorbers. The drum is rotated by an electric motor (not shown), which transmits the rotating motion of a motor shaft to the drum by a belt/pulley system. In a different embodiment of the invention, the motor can be directly associated with the shaft of the drum. The tub is preferable connected to casing 6 by means of an elastic bellows or gasket. Alternatively, the laundry appliance can be a dryer (in which case the tub is not provided) or a combined washer and dryer.

The preferred washing machine shown in FIG. 1 comprises a drawer 30 with a front plate 34 and a handle 38 for pulling out and pushing back in drawer 30. Drawer 30 comprises at least one compartment for detergent or washing additives. Adjacent to drawer 30, a rotatable user interface element, preferably a rotatable knob 44, is arranged for preferably selecting a laundry treatment program and/or at least one parameter of a laundry treatment program. According to a preferred embodiment of the present invention, the rotatable user interface element can be a rotatable knob, preferably comprising a push button and/or a display, or generally any user interacting component allowing an active interaction (through choice/adjustment of programs/parameters) and/or a passive interaction (through the display of programs/parameters) between the user and the machine.

Adjacent to knob 44 on the opposite side of drawer 30, a light group 50 is arranged which comprises a plurality of light elements 54 of which in FIG. 1 only two are labelled. Light elements 54 preferably form a light row 58, which in the mounting position of laundry washing machine 2 is preferably arranged vertically and perpendicular to the lateral extension (width) of laundry washing machine 2. The mounting position shown is the regular orientation of the washing machine for operation. Each of said light elements 54 is preferably built as an LED.

On the side of light row 58 opposite to the side where the user interface element/drawer are provided, preferably a transparent inlay or cover 60 is arranged which preferably covers the user interface or a portion thereof, such as a display, preferably an LCD. Cover 60, light group 50 and knob 44 are preferably components of a user interface 62 which allows a user to control laundry washing machine 2, especially to select a laundry treatment program and/or at least one parameter and also to obtain information on the current status of laundry washing machine 2.

Figure 2:
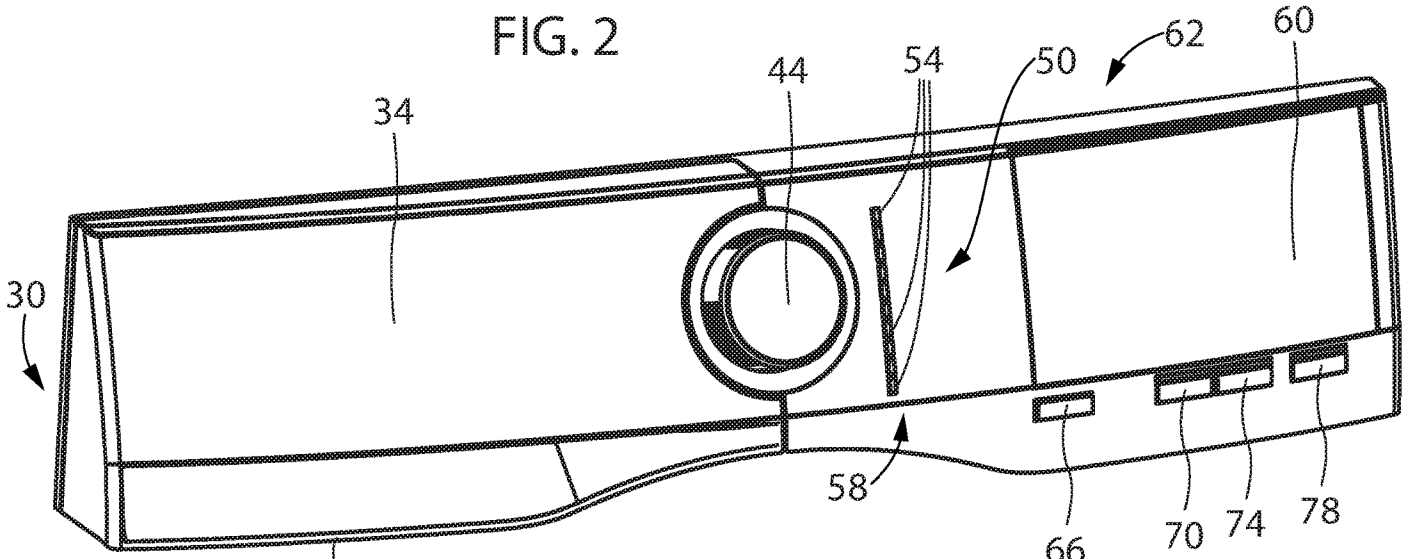
FIG. 2 shows a knob, a cover, a drawer, a light group and a user interface of the laundry washing machine according to FIG. 1 in a preferred embodiment.

In FIG. 2, user interface 30 and drawer 30 of laundry washing machine 2 are shown in an enlarged view. Shown in addition is a push button 66 and three further push buttons 70, 74, 78 preferably suitable for adjustment of further parameters or the selection of further programs.

The knob 44 when being turned by a full round of 360° engages in a discrete number of defined rotational positions. The household appliance 2 is configured in such a way that a rotation of knob 44 in one direction (clockwise/counterclockwise) results in an illumination or turning off of light elements 54, preferably in a sequence. Household appliance 2 comprises an electronic control unit which receives an electronic signal that represents the current rotational position of the knob 44. The rotational position of the knob 44 is detected by an encoder which is preferably arranged on an electronic board arranged behind knob 44 which also comprises the electronic control unit. The electronic board is electronically connected to each light element 54 of light group 50. Depending on the current rotational position of knob 44 and the illumination state of light group 50, it illuminates and/or turns off a respective light element 54, several light elements 54, or all of them.

The push buttons 66, 70, 74, 78 which are arranged below display 60 can preferably be used to adjust further parameters or select further programs as explained above. While light elements 54 of light group 50 are, as described, preferably related to the knob 44 in a sense that they yield optical feedback on the current position/state of knob 44, a display arranged beneath cover 60 (see below) is preferably used to provide to the user information on the selected program, the parameters, the remaining treatment time, possible error or maintenance related messages etc.

As can be inferred from both FIGS. 1 and 2, light elements 54 are in the current preferred embodiment only arranged on the side of knob 44 which is opposite to drawer 30. In other words, preferably no light elements 54 and therefor no light group 50 are arranged between knob 44 and drawer 30. The light elements 54 and all other components which are part of or arranged on user interface 62 are positioned on the side of knob 44 opposite to drawer 30; consequently, on the side of the user interface element opposite to the light group 50, only the drawer is visible to a user. In this way, the lateral space available for the drawer 30 and/or for the drawer handle 38 is larger compared to common designs where lights are arranged on both sides of the user interface element or knob 44.

Additionally, the user is presented with a clear-cut layout of parts and components. All controls and display elements are arranged on the same side with respect to the drawer 30, in the shown example on the right side of knob 44 with respect to the frontal view of the household appliance. This reduced confusion of a user, who might not be able to recognize which controls are of importance or might simply overlook certain controls or display or indication elements.

Figure 3:
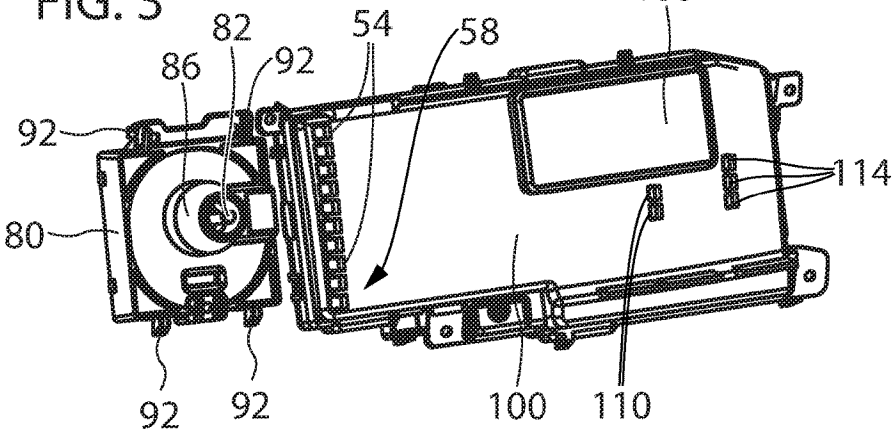
FIG. 3 shows components hidden in FIG. 2 behind knob and cover.

In FIG. 3, in which the knob 44 and the cover 60 are not shown, a first preferred embodiment about the application of the user interface element encoder and of the light group 50 is depicted. In said preferred embodiment, a box 80 is configured for receiving the encoder of the knob 44 and transmitting its position to a control unit (not shown). The control unit, for instance, accesses light elements 54 to illuminate them according to the position of the encoder and of the knob 44. Said encoder comprises a pin 82 which is received by a hull or sheath of knob 44 and also provides a protection wall 86 merging from the box 80. Box 80 preferably comprises four connecting elements 92 for connecting said knob to a support frame deriving from/provided on the front wall 10.

An electric board 100 comprises the light elements 54 as well as a display 106 for displaying information regarding the machine state, the selected program etc. as described above. Component 100 also provides further light elements 110 and 114. Preferably, either on component 100 and/or on cover 60, symbols or texts are provided related to light elements 110, 114.

Figure 4:
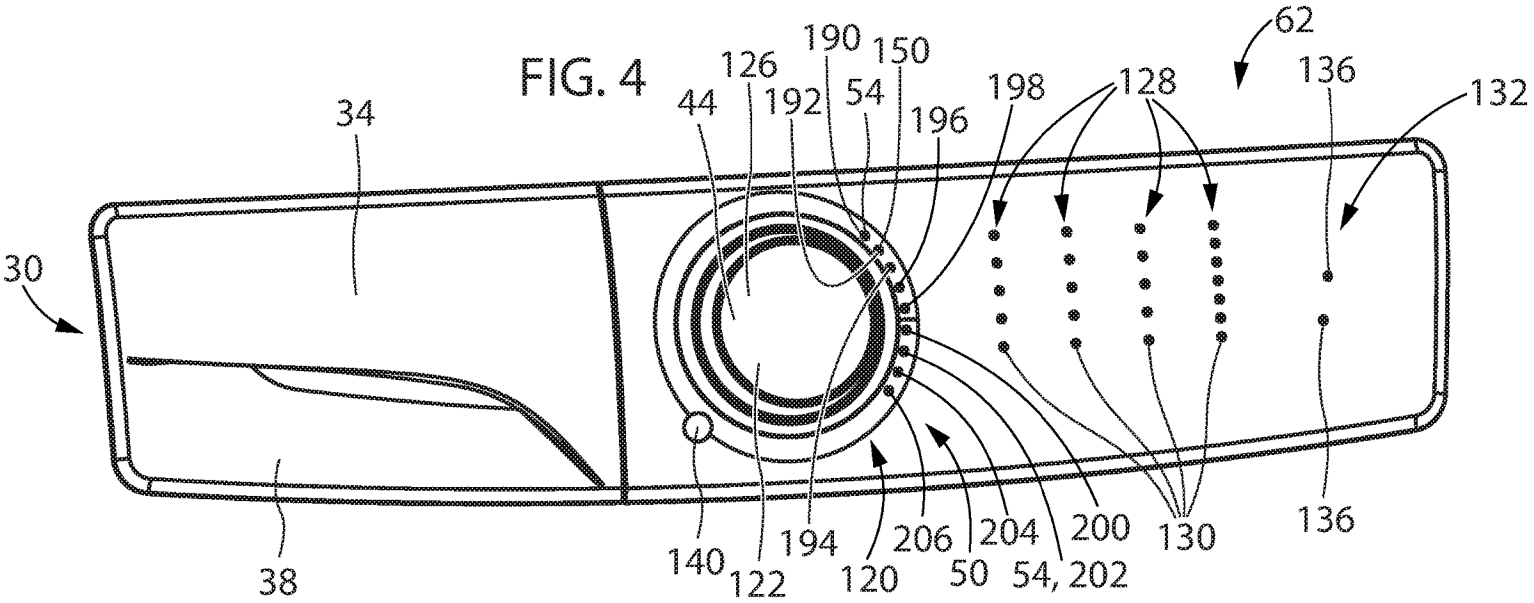
FIG. 4 shows a knob, a cover, a drawer, a light group and a user interface of a laundry washing machine in another preferred embodiment.

In FIG. 4, a front part of a laundry treatment machine 2 in another preferred embodiment is shown. The light group 50 of light elements 54 in this embodiment are arranged a rounded row 120; as shown in FIG. 4, the light elements are, respectively, disposed at a different angle with respect to the knob 44. The light elements 54 are thereby arranged along a segment of a circle which is concentric with a middle axis of knob 44 which is perpendicular to its surface 122.

The bent or rounded arrangement of light elements 54 has two advantages. Firstly, by the close positioning around knob 44, in which every light element 54 preferably has the same distance to a center 126 of knob 44, space on user interface for other user interface components is provided. Secondly, the arrangement of the light group 50 of light elements concentric with knob 44 clearly and in an intuitive way indicates to the user the connection or link between the illumination of one or several light elements 54 and the rotational state of knob 44. According to said preferred embodiment, the user interface element comprises a knob and a display placed internally, fixed in a non-rotatable manner to the box 80 (see below), and so to the household appliance.

On user interface 62, four light rows 128 with, respectively, five light elements 130 are arranged as well as one light row 132 with two light elements 136. Between knob 44 and drawer 30, a switch 140 is provided, preferably of the touch-sensitive type. Switch 140 is preferably used to start and/or pause and/or stop a selected laundry treatment program.

Figure 5:
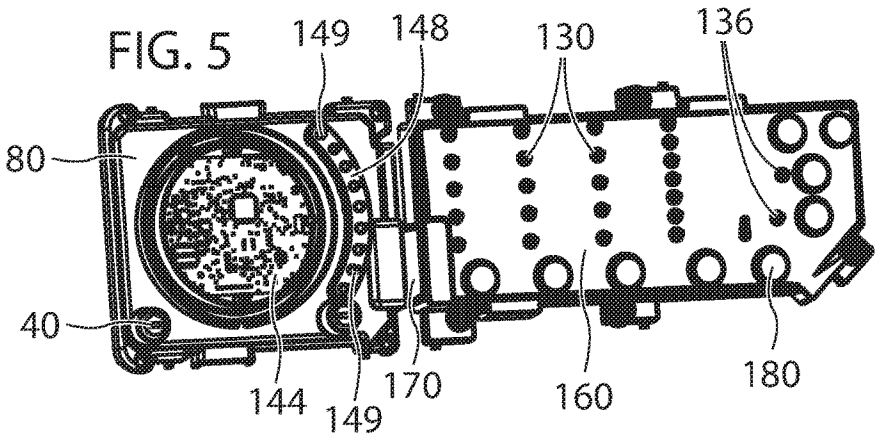
FIG. 5 shows components hidden in FIG. 4.

In FIG. 5 the knob and the front panel have not been shown, depicting a second preferred embodiment, wherein the user interface element 44, the light group 54 and preferable the switch 40 are integrated on the box 80; the latter holds a control circuit board 144 suitable to comprise the control unit that preferably receives the signal from the user interface element and to manages the illumination of the light elements comprised on the light group. Preferable, said lights comprised on the light group are associated with a light guide 148 configured to transmit the light from each light element to a respective external protrusion 149 provided on said light guide, emitting the light to the external side of the front panel, passing through holes 150 provided on the latter.

Preferably, said integrated box 80 is electrically connected with the main board 160 of the user interface through an electrical connection 170 laterally placed between them. On main board 160, touch sensitive switches 180 are arranged which enable the user to adjust parameters and/or (sub-) programs or to start/confirm additional operations. The operation or switching of the touch sensitive switches 180 preferably leads to a change of illumination of at least one light belonging to light rows 128.

In FIG. 5 the light elements 54 are labelled separately by reference numerals 190-206 from top to bottom along the arc in which they are arranged on the right side of knob 44.

The laundry washing machine 2 is built to provide the user with a convenient and high-quality user experience. To this end, the number of defined rotational positions along the full round of rotation of knob 44 is larger than the number of light elements 54 in group 50.

This configuration allows implementing relationships between the rotational position or movement of knob 44 and the illumination state of light elements 54 which would not be possible if the number of rotational positions or steps of knob 44 would be equal to the number of light elements 54. Below, several preferred configurations are described in detail.

Preferable, the plurality of light elements 54 are interrelated with each other in a sense that their switching on/off is alternatively/successively/logically linked with each other for the indication of parameters preferably belonging to the same field, in particular through the operation of the user interface element.

Alternatively, only one light element 54 is illuminated, i.e. no a plurality of light elements 54 is illuminated contemporaneously. Preferably, light elements 54, which are preferably LEDs, are illuminated in a sequence from the upper light element to the bottom one or vice versa in dependence of the user interface element adjustment or movement, for example in dependence on the clock or counter-clock rotation of the knob 44, respectively.

Preferably, the lights elements 54 composing the light group 50 interact with each other; preferably the illumination of each light element 54 depends on the illumination sequence of the light elements 54 comprised on the light group as a whole, with respect to the knob rotation direction.

According to a preferred embodiment, when the appliance is switched on, the upper light element 54 or LED of an essentially vertically arranged group 50 of lights is illuminated; preferably, the illumination of said LED corresponds to a description of a program/parameter placed/marked on the user interface 30 in correspondence/laterally to the illuminated LED. If the user wants to change the program, she/he can rotate the knob 44 in the clockwise direction, until to the next rest rotational position of said knob is reached. Due to said knob rotational movement, the upper LED is switched off, whereas the adjacent LED, placed on the bottom side with respect to the first, is illuminated; the illumination of the second led can preferably correspond to a different program/parameter, the name of which is marked on said user interface in correspondence to/laterally to said LED.

If the user rotates the knob in the clockwise direction too, the second LED switches off and the third LED illuminates, and so on; on the other hand, if the user rotates the knob in the counterclockwise direction, the second LED is switched off and the first LED is illuminated; therefore, on said preferred embodiment, the LEDs are illuminated according to a sequence corresponding to the switching on of a LED followed by a substantial contemporaneous switch off of a LED that is adjacent with respect to those just switched on; if the illuminated LED has two adjacent LED, the illumination of one respect of the other preferably depends of the direction of the knob rotation.

Further preferable, if the illuminated LED has exactly one adjacent LED only, because for example it is the LED provided on the extremity of the LED row, it the user rotates the knob in the direction opposite to the direction necessary for illuminating the adjacent LED, the illuminating sequence can be configured to illuminate the LED of the opposite extremity with respect to those yet switched off.

According to a preferable alternative embodiment, the LEDs are illuminated in sequence, without the switching off of the previous one; for example, when the appliance is switched on, the upper LED is illuminated; if the knob is rotated in a clockwise direction, the second LED, adjacent to and placed on the bottom side of the upper one, is illuminated; if the knob is rotated in a clockwise direction too, also the third led is illuminated, and so on; in case the knob is rotated in the counterclockwise direction, the second LED is switched off.

Therefore, using the same principle of the above described preferred embodiments, the LEDs are switched on or switched off in sequence, depending of the rotation direction of the knob, but keeping switching off/on if the next/previous LED has to switch off/on, respectively.

The fact that the number of knob steps is larger than the LEDs allows additionally the following functionality. When the last LED or light element 54, for instance the bottom one by a clockwise turning of knob 44, has been illuminated and the knob 44 is further turned in the same direction to the next defined rotational position, all light elements 54 are turned off in the case that all are illuminated or the last light element 54 is turned off if only this one is illuminated. Even further turning the knob 44 then preferably starts again the illumination sequence from the beginning. The user therefore does not have to turn the knob 44 all the way back to start the sequence again.

Due to the described association of knob 44 and light elements of light group 50, the user obtains a clear and immediate feedback on her or his current selection. The appliance 2 reacts in a very direct and responsive way to her or his choices. Since the knob 44 is the primary operating element of the household appliance 2, the user projects this handling and quality on the whole appliance 2.

The preferred illumination sequences are now described with respect to the labeled light elements 190-206. In the preferred embodiment shown, in a start sequence, when the knob 44 is turned in clock-wise direction to a defined rotational position or when the machine is switched-on, light element 190 at the top is illuminated. When knob 44 is further turned in clockwise direction to the adjacent defined rotational position, light element 192 is illuminated and light element 190 is turned off. When the knob 44 is further turned in the same direction, light element 192 is turned off and adjacent light element 194 is turned on. Therefore, only one light element is illuminated contemporaneously. This sequence continues until light element 206 at the bottom is turned on and is the only illuminated light element. Further turning of knob 44 in the same clockwise direction makes light element 206 turned off.

When the user still further turns knob 44 in clockwise direction, the described illumination sequence starts again with the illumination of light element 190. In another version, when light element 206 is turned off, simultaneously the sequence starts again with the illumination of light element 190.

In another preferred embodiment, when the next light element 54 is illuminated, the previously illuminated light element 54 stays illuminated. In the shown embodiment, in the sequence by turning knob 44 in clockwise direction, when light element 192 is illuminated, light element 190 stays illuminated. When light element 194 is illuminated, all previous light elements 54, in this case light element 190, 192, stay illuminated. When light element 206 gets illuminated, all light elements 190-206 are illuminated. Still further turning of knob 44 then simultaneously turns off all light elements 192-206. Still further turning starts the sequence again with the illumination of light element 190.

In both described cases, counter-clockwise turning leads to a turning off of the last illuminated light element 54. In the second case that previous light elements remain illuminated in the sequence, counter-clockwise turning leads to a successive turning off of light elements 54 from bottom to top. For instance, if light element 200 was illuminated in a sequence of clockwise turning of knob 44 and now the turning direction is changed, light element 200 is turned off, while light elements 190-198 stay illuminated. This can continue until light element 192 is turned off and all light elements are turned off. When the user still turns the knob 44 counter-clockwise, all light elements 190. 206 can be illuminated again.

In the first case, when light element 200 is turned off, light element 198, which was not illuminated is turned on or illuminated again. This continues until light element 190 is the last light element being illuminated in this backwards sequence. When the knob is continuing in counter-clockwise direction, light element 190 is turned off. Simultaneously or by still further turning to the next defined rotational position, light element 206 is turned on again. The illumination of light elements 190-206 can also depend on the rotational movement, especially the rotational speed at which knob 44 is turned.

While the present embodiment shown is a laundry washing machine, aspects of the invention also encompass combined washers and dryers or dryers with a drawer.

The invention thus conceived can be subjected to numerous modifications and variants all falling within the scope of the inventive concept. In addition, all details can be replaced by other technically equivalent elements. In practice, all the materials used, as well as the shapes and contingent dimensions, may vary depending on the requirements without departing from the scope of protection of the following claims.

The invention claimed is:

1. A household appliance, comprising a rotatable user interface element which during a rotation by one full round engages in a discrete number of defined rotational positions, wherein at least one group of light elements is provided, wherein said appliance is configured such that one or more light elements of the group are illuminated and/or can be activated depending on the rotational position and movement of said rotatable user interface element, whereby said discrete number of rotational positions of the rotatable user interface element is larger than a number of the light elements in said group.

2. The household appliance according to claim 1, wherein when said rotatable user interface element is turned to an adjacent rotational position, the illumination state of said group of light elements is changed.

3. The household appliance, according to claim 2, wherein when said rotatable user interface element is turned in one direction, said light elements of said group illuminate or turn off in a sequence.

4. The household appliance according to claim 2, wherein the illumination state of a light element of said group depends on the illumination state of said whole group for the current turning direction of said rotatable user interface element.

5. The household appliance according to claim 3, wherein the sequential illumination or turning off of said light elements of said group depends on the number of subsequently reached rotational positions.

6. The household appliance according to claim 3, wherein the illumination or turning off of said light elements of said group depends additionally on the rotational speed at which said user rotatable interface element is turned.

7. The household appliance according to claim 3, wherein when said rotatable user interface element is turned in opposite direction to the direction in which said light elements of said group art illuminated, said light elements said group turn out in a sequence.

8. The household appliance according to claim 3, wherein, when the last light element of said group is illuminated in the sequence, such that all light elements are/have been illuminated, an additional turn of said rotatable user interface element in the one direction of said light elements being illuminated results in said light elements turning off.

9. The household appliance according to claim 8, wherein further turning of said rotatable user interface element in the same direction starts again the sequence of illuminations of said light elements of said group.

10. The household appliance according to claim 3, wherein when the respective next light element is illuminated in a sequence, the previously illuminated light element stops being illuminated.

11. The household appliance according to claim 3, wherein when the respective next light element is illuminated in a sequence, the previous light element remains illuminated.

12. The household appliance according to claim 1, wherein said group of light elements is arranged peripherally to said rotatable user interface element.

13. The household appliance according aim is said rotatable user interface element is a knob.

14. The household appliance according to claim 1, wherein said group of light elements is essentially arranged vertically in an operational state of said appliance, and whereby a clockwise rotation of said rotatable user interface element illuminates said group from top to bottom.

15. The household appliance according to claim 1, wherein said group of light elements is essentially arranged vertically in an operational state of said appliance, and whereby a counterclockwise rotation of said rotatable user interface element illuminates said group from bottom to top.

* * * * *